US006024638A

United States Patent [19]

Berlin et al.

[11] Patent Number: 6,024,638

[45] Date of Patent: Feb. 15, 2000

[54] FUME HOOD HAVING A DRIVEN SASH AND A TRAVEL INTERFERENCE SYSTEM FOR THE SASH

[76] Inventors: Robert L. Berlin, 2040 Erickson, Linwood, Mich. 48634; Richard L. Wendt, 2605 Georgetown; Warren L. Zeigler, 5205 Swede Rd, both of Midland, Mich. 48640

[21] Appl. No.: 09/083,322

[22] Filed: May 22, 1998

Related U.S. Application Data

[63] Continuation-in-part of application No. 08/344,010, Nov. 23, 1994, abandoned.

[51] Int. Cl.[7] ..... B08B 15/02

[52] U.S. Cl. ..... 454/56; 49/25

[58] Field of Search ..... 49/25; 454/56, 454/61

[56] References Cited

U.S. PATENT DOCUMENTS

| | | | |
|---|---|---|---|
| 2,909,718 | 10/1959 | Lawick | 160/188 X |
| 4,274,226 | 6/1981 | Evans | 49/25 |
| 4,774,878 | 10/1988 | Berlin et al. | 454/56 |
| 4,953,608 | 9/1990 | Larsson | 49/25 X |
| 5,357,183 | 10/1994 | Lin . | |

*Primary Examiner*—Harold Joyce
*Attorney, Agent, or Firm*—Robert L. McKellar

[57] ABSTRACT

A fume hood having a trimodal piston driven sash operator which have been improved by the addition of a travel interference system for the moveable sash to prevent accidents and the possible breakage of glassware and the like.

2 Claims, 3 Drawing Sheets

FUME HOOD HAVING A DRIVEN SASH AND A TRAVEL INTERFERENCE SYSTEM FOR THE SASH

This is a continuation-in-part of Ser. No. 08/344,010, filed Nov. 23, 1994 abandoned.

BACKGROUND OF THE INVENTION

The instant invention deals with an improved fume hood having a trimodal piston driven sash operator. More specifically, this invention deals with fume hoods which are state of the art fume hoods, which have been further improved by the addition of a travel interference system for the moveable sash of such a hood.

Fume hoods are a common item of most every chemical laboratory and have been employed in one form or another for many years. As new materials and techniques are evolved, the fume hood undergoes modifications to attempt to ensure working personnel freedom from spills and burns, noxious gases and chemicals.

Most recently, a patent was issued to the inventors named herein, i.e. U.S. Pat. No. 4,774,878, which issued on Oct. 4, 1988, in which there is described a trimodal piston driven sash operator for use in fume hoods.

BRIEF SUMMARY OF THE INVENTION

The benefits of this type of fume hood are a new and novel means of driving a sash member in an access opening; a means for interrupting the movement of the sash member in the access opening at any point in the cycle of opening and closing of the sash; a manual override switching system in which the flow of air via the blower motors, the duct damper and the sash member can be manually controlled outside of the interconnected electrical system of the hood, plus many more features and benefits. The U.S. Pat. No. 4,774,878 is incorporated herein by reference for what it teaches about the state of the art regarding novel fume hoods and their various parts and their relationship to each other.

However, in that patent, there is no provision for a travel interference system for the movable sash. A travel interference system for purposes of this invention means that a system is employed with the fume hood to read the area at the leading edge of the sash, under the sash, and determine if there is anything in the access opening, under the direct travel of the sash, that would cause interference with the downward travel of the sash. Upon reading and determining that there is an object or objects in the direct line of downward travel of the sash, the system automatically stops the downward travel of the sash, sounds an alarm, and the sash remains open until the object or objects are removed, or the operator manually overrides the travel interference system. The travel interference system of this invention allows a reading of the access opening even when the object in interference is glass, which those skilled in the art know is transparent and generally does not provide a substrate on which the beam of the travel system can focus. The light from the photocell is polarized light which turns its beam 90° for the reflected return to the photocell. If the returning beam hits a glass substrate, the beam is distorted and it hits the photocell sensor in this distorted fashion signaling the cell that something is in the path.

What is contemplated as one embodiment of the invention is an improved fume hood. The fume hood comprises in combination, an access opening in one wall having a top and a bottom, and there is mounted in said access opening, a movable sash member. There is also a power source and drive means for the sash member. This invention differs from the fume hood of the above-described patent in that there is also used a travel interference system for the sash member comprising a powerable photocell having a sensor beam. The is also present a sensor/reflector for the photocell. The photocell is mounted in the access opening and the photocell is mounted such that it is interior to the movable sash member and it's sensor beam projects across the access opening in essentially a horizontal line to the sensor and is reflected back to the photocell without any substantial interference with the photobeam.

BRIEF DESCRIPTION OF THE DRAWINGS

FIG. 2A is a front plan view of a photocell of this invention.

FIG. 2B is a side plan view of a photocell of this invention.

FIG. 2C is a back plan view of a photocell of this invention.

FIG. 2D is a front plan view of a reflector of this invention.

FIG. 2E is a side plan view of a reflector of this invention.

FIG. 2F is a side plan view of a cable guide of this invention.

FIG. 2G is a side plan view of a cable guide of this invention.

DETAILED DESCRIPTION OF THE DRAWINGS

Figure 1:
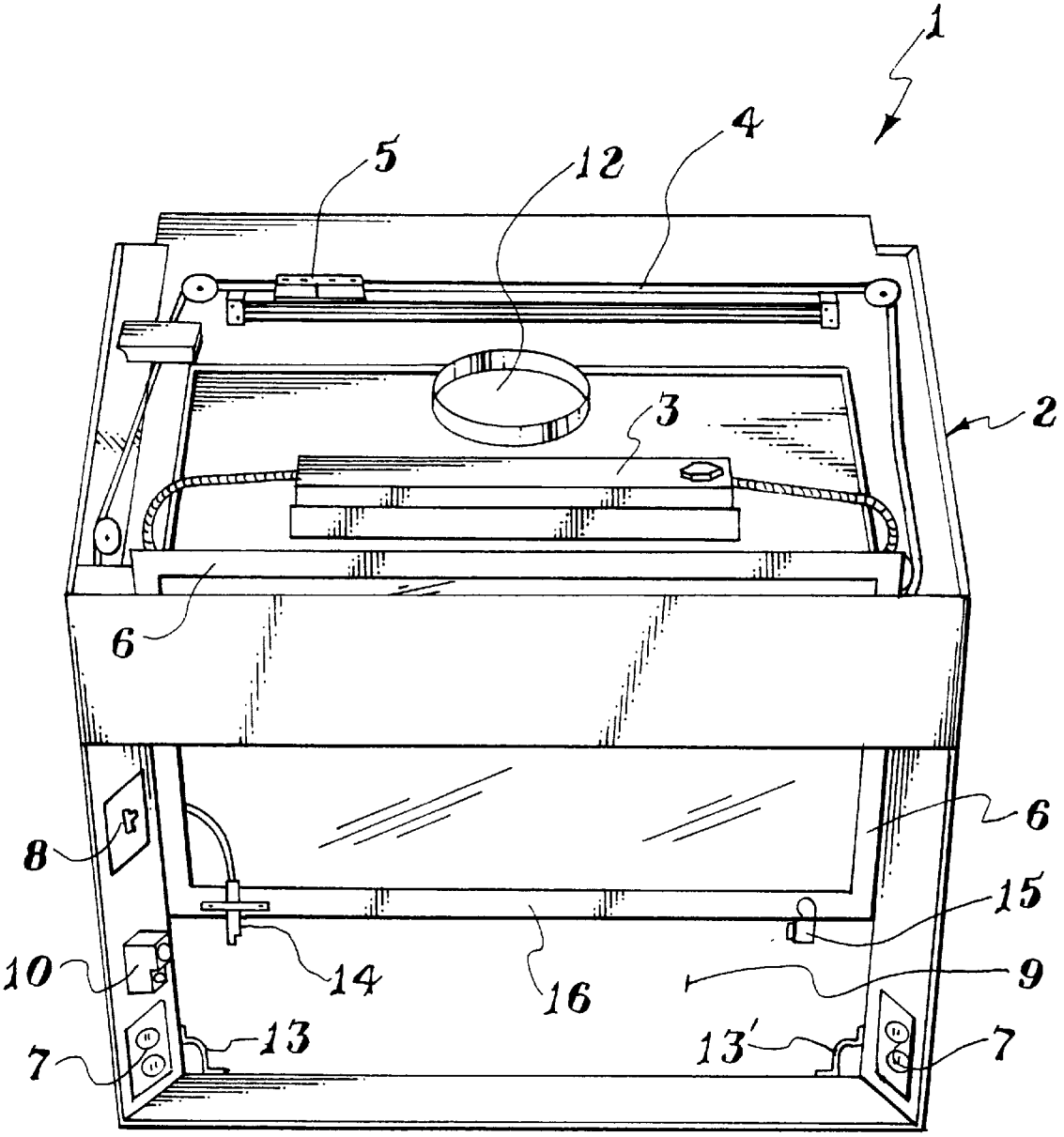
FIG. 1 is an isometric front view of a fume hood of this invention.

Now making reference to FIG. 1, there is shown an isometric front view of a fume hood 1 of this invention in which there is shown generally, a housing 2 and some of the accessory items commonly found in this type of fume hood such as a lighting fixture 3, a pressure cylinder 4, the drive means 5 of the pressure cylinder 4, and the moveable sash member 6. Not shown for clarity reasons are the cable and pulleys, and the dropping dead weight of the fume hood 1, the details of which can be found in the above mentioned U.S. Patent.

Also shown are various switch plates 8 and electrical outlets 7, and the like, which are common on fume hood front surfaces. Shown at 9 is the access opening in which the moveable sash 6 moves in a vertical line. Mounted on the front of the fume hood housing 2 is an external photocell 10, said photocell 10 being described in detail in the U.S. patent mentioned above. The exterior photocell 10 does not cooperate with or become any part of the travel interference system of this invention. There is further shown on the fume hood 1, an air exhaust port 12, cable guides 13 and 13', the interior photocell 14 and the reflector 15 for the photocell 14. The photocell 14 and the reflector 15, and their positioning on the bottom edge 16 of the moveable sash 6, constitute the essence of this invention. It should be understood by those skilled in the art that the photocell 14 and reflector 15 can be substituted by a photoelectric cell and a photoelectric sensor which are spaced apart across the front opening of the fume hood.

Figure 2A:
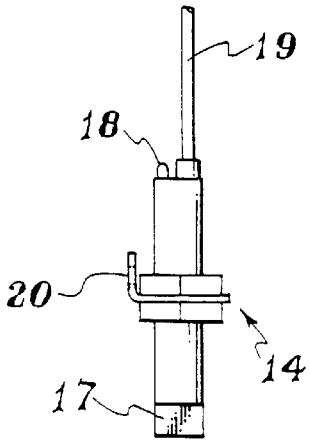
FIGS. 2A to 2G are detailed views of the photocell, the sensor, and the cable guides useful in this invention and are thus.

Turning now to the series of FIGS. 2 and with reference to 2A to 2C, there is shown the front, the side, and the back, respectively, of the interior photocell 14 wherein in FIG. 2A, there is shown the beam window 17 of the photocell 14, a signal light 18 which indicates a break or interruption in the sensor beam of the photocell 14, power cable 19, and a mounting bracket 20.

Figure 2B:
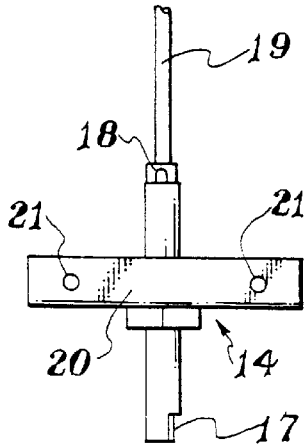

With regard to FIG. 2B, there is further shown holes 21 in the mounting bracket 20, for mounting the photocell 14 on the bottom edge 16 of the moveable sash 6.

Figure 2C:
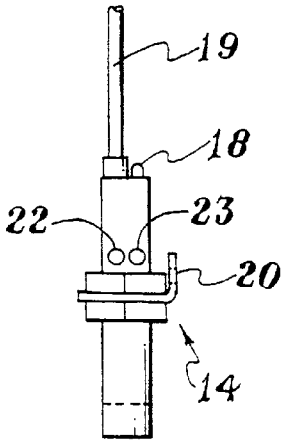

Further, with regard to FIG. 2C, there is shown in addition to the above, two adjustments, namely, a sensitivity or gain adjustment for high and low 22, and a light and dark adjustment shown at 23.

Figure 2D:
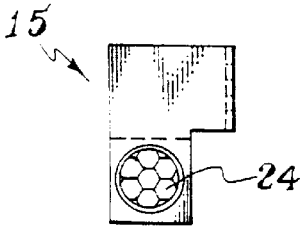
Figure 2E:
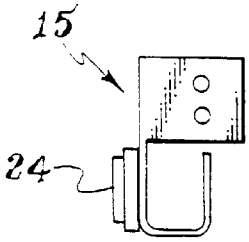

FIG. 2D is a front view of the reflector 15 for the photocell 14 and there is shown therein the reflector surface 24 and a unitary mounting bracket 25 for the reflector 15. With reference to FIG. 2E, there is shown the reflector 15 in a side view with the reflector surface 24 and mounting bracket 25, clearly shown.

Figure 2F:
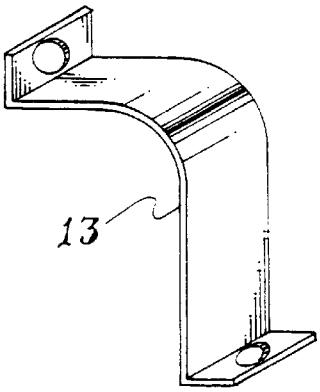
Figure 2G:
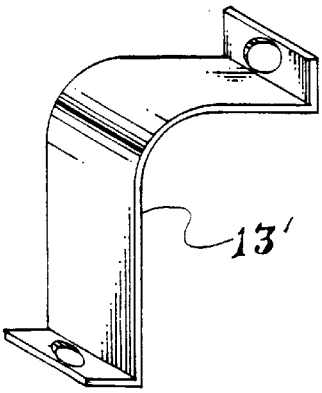
Figure 3:
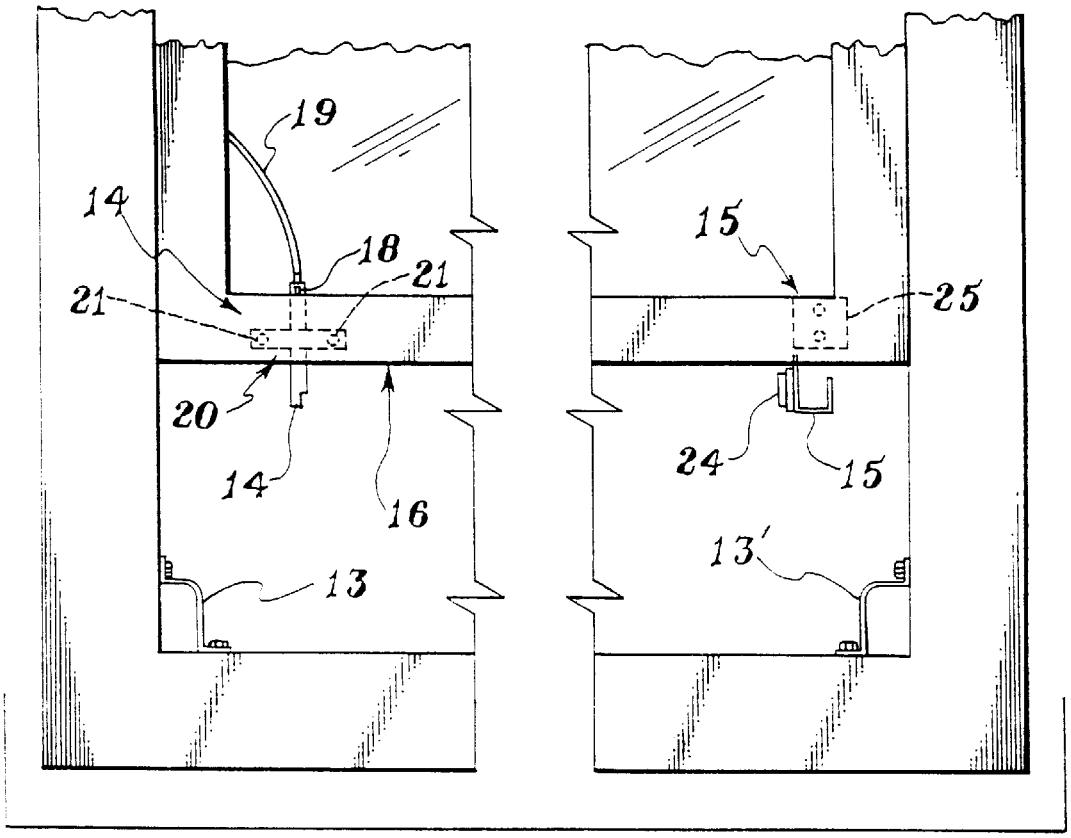
FIG. 3 is a blown up front plan view in fragmentation, of the bottom half of the fume hood shown in FIG. 1, setting forth the photocell and the reflector.

Finally, there is shown in FIG. 2F and 2G, cable guides 13 and 13', the utility of which will be described infra.

Figure 4:
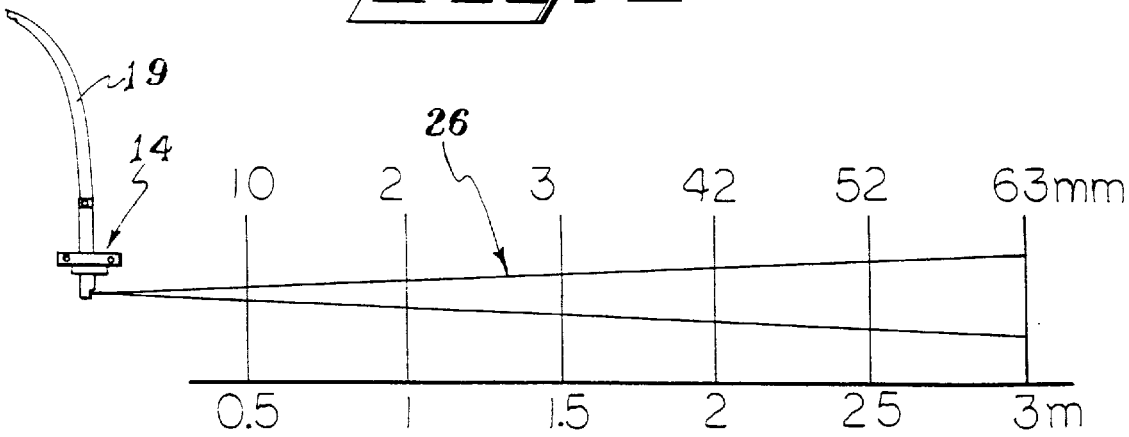
FIG. 4 is a top and side view of the photocell showing the area of it's sensor beam.

Turning now to FIG. 4, there is shown on the left side of the Figure, a photocell 14 of this invention, with a facsimile of a beam 26 that would be projected by the photocell 14 in use in this invention. It should be noted that the beam 26 is projected over a distance of 3 meters and still has a narrow width. FIG. 4 is a top and side view of the photocell showing the area of it's sensor beam.

In the operation of the sash member it is desired to have the ability to instantly stop or start the movement of the sash member without interruption of or strain on the power source. It is also desirable that once the movement of the sash member has been interrupted, it can automatically resume such movement to either finish opening or finish closing the sash member 6. In this manner, the sash member can be automatically opened or closed; it can be interrupted when it is moving into the open or closed position without damage to the element which obstructed the movement of the sash member, and, once interrupted, the sash member can pause, then continue and finish the cycle of its intended movement. For example, it was noted in U.S. Pat. No. 4,774,878, that if in a chemistry laboratory wherein the invention of that patent was being used, and the hood of the invention was adapted to a photo electric eye and associated means, and if a glass beaker, for example, were carelessly left in the path of travel of the sash member when it was closing, the sash would strike the glass beaker, the sash member immediately would stop, lightly rest against the object for a pre-set period of time (perhaps 1 to 2 seconds) and then the drive means for the sash member would automatically stop and the sash member would remain in the stop position, It would not open and provide an energy loss, nor would the sash oscillate in the access opening. The sash would remain in the obstructed open position until the operating personnel removed the object and reactivated the drive means for the sash member, at which point the system would automatically recycle the sash member to a fully closed or fully opened position, depending on the presence or absence of operating personnel.

The instant invention differs in that the photocell 14 and the reflector 15, which are mounted interiorally of the moveable sash member 6, allow for the photocell 14 to beam horizontally to the reflector 15. Since the photocell 14 and the reflector 15 are mounted on the bottom edge 16 of the sash member 6, the beam 26 strikes any obstructing object first. Upon disruption of the beam 26, the moveable sash stops, without touching the obstruction, a warning signal is sounded (in the case of a light, the light either burns constantly, or intermittently), the sash member 6 moves to a preset position in the access opening 9, the sash member 6 is held in the preset position for a preset time, and then the sash member 6 moves downwardly until the beam 26 strikes the object of interference again, whereupon, the sash member 6 moves once again to the preset position. This movement of the sash member 6 to the preset position and its timed delay in the preset position, and its advance in the downwardly direction are repetitive until an operator removes the obstruction. If should be noted that the sash member 6 never strikes the obstruction in this travel interference system.

Cable guides 13 and 13' are used in the lower corners of the access opening 9 to allow the passage of cable, hoses and other such lines into and out of the access opening 9 without causing the travel interference system to activate.

This invention has many benefits, but the benefit of preventing "reach in" accidents by laboratory personnel, and the benefit of the sash member 6 from never striking the obstruction, are the two most important.

Thus, it can be observed that this invention is new and novel in the art and provides some measure of safety to laboratory operating personnel.

What is claimed:

1. A fume hood, said fume hood comprising in combination, an access opening in one wall having a top and a bottom, and mounted in said access opening, a movable sash member; a power source and drive means for the sash member, the improvement comprising:

a travel interference system for the sash member comprising a powerable photocell having a sensor beam;

said photocell being rigidly mounted on the bottom edge of the sash member;

a reflector for the photocell, rigidly mounted oppositely the photocell on the bottom edge of the sash member such that the sensor beam projects across the access opening in essentially a horizontal line to the reflector.

2. A fume hood, said fume hood comprising in combination, an access opening in one wall having a top and a bottom, and mounted in said access opening, a movable sash member; a power source and drive means for the sash member, the improvement comprising:

a travel interference system for the sash member comprising a powerable photocell having a sensor beam;

said photocell being rigidly mounted on the bottom edge of the sash member;

a photosensor for the photocell, rigidly mounted oppositely the photocell on the bottom edge of the sash member such that the sensor beam projects across the access opening in essentially a horizontal line to the photosensor.

* * * * *